US006298623B1

(12) United States Patent
Wendt

(10) Patent No.: US 6,298,623 B1
(45) Date of Patent: Oct. 9, 2001

(54) ADJUSTABLE TRIM STRIP SYSTEM

(75) Inventor: Alan C. Wendt, Barrington, IL (US)

(73) Assignee: USG Interiors, Inc., Chicago, IL (US)

( * ) Notice: Subject to any disclaimer, the term of this patent is extended or adjusted under 35 U.S.C. 154(b) by 0 days.

(21) Appl. No.: 09/591,303

(22) Filed: Jun. 9, 2000

(51) Int. Cl.[7] ..... E04B 9/00

(52) U.S. Cl. ..... 52/506.06; 52/39; 52/665; 248/343

(58) Field of Search ..... 52/718.01, 715, 52/506.06, 506.08, 506.09, 506.1, 665, 39, 220.6, 220.7; 174/48; 248/72, 342, 343

(56) References Cited

U.S. PATENT DOCUMENTS

| | | | | |
|---|---|---|---|---|
| 3,333,387 | | 8/1967 | Deakins | 52/664 |
| 3,602,473 | | 8/1971 | Van Riet et al. | 248/317 |
| 3,678,641 | * | 7/1972 | Englund et al. | 52/484 |
| 4,019,300 | * | 4/1977 | Sauer et al. | 52/665 |
| 4,229,918 | | 10/1980 | Delcroix | 52/242 |
| 4,373,111 | * | 2/1983 | Myers et al. | 174/48 |
| 4,890,428 | | 1/1990 | Platt | 52/238.1 |
| 5,195,289 | | 3/1993 | LaLonde et al. | 52/484 |
| 5,201,787 | | 4/1993 | LaLonde et al. | 52/484 |
| 5,413,300 | | 5/1995 | Hosteing | 248/317 |
| 5,421,551 | * | 6/1995 | LeClaire | 248/257 |
| 5,937,605 | | 8/1999 | Wendt | 52/506.06 |
| 5,979,134 | | 11/1999 | Neff | 52/506.07 |

* cited by examiner

*Primary Examiner*—Carl D. Friedman
*Assistant Examiner*—N. Slack
(74) *Attorney, Agent, or Firm*—Lee, Mann, Smith, McWilliams, Sweener and Ohlson; John M. Lorenzen; David Janci

(57) ABSTRACT

This invention is directed to a stand-alone adjustable trim strip system that can be used for the attachment of lighting and signs. The trim strip system is designed to conceal hardware used for attaching lighting and signs and also provides for a system that can be adapted to accommodate architectural design. The system has the capability of being suspended from the structure of a building by wires or rods or can be affixed to walls or ceilings by using fasteners. The system is comprised of one or more trim strips and brackets that can be shaped into different polymeric shapes or can be arranged in a grid format. The system has the ability to attach electric lighting and signs while providing for an aesthetically pleasing structure.

15 Claims, 19 Drawing Sheets

ADJUSTABLE TRIM STRIP SYSTEM

BACKGROUND OF THE INVENTION

This invention may be described as a stand-alone adjustable trim strip system used for architectural design that can be suspended from the structure of a building by wires or rods or affixed to walls or ceilings which allows for the optional attachment of electric lighting and signs while concealing electrical wiring hardware and provides for an aesthetically pleasing structure.

DESCRIPTION OF RELATED ART

The present invention relates to a stand-alone adjustable trim strip system for decorative purposes which can be adapted to conceal electrical hardware and allow for the mounting of lighting systems and signs. The invention can further be suspended from the structure of a room by using wires or rods or fastened to walls or ceilings to create the appearance of suspended trim.

When designing the layout of lighting and signs for rooms in buildings with elevated ceilings such as those found in office buildings and retail spaces, it is desirable to provide a system which allows for the optimum placement of lighting systems and signs without the need for custom lighting or expensive suspension ceiling systems. It is further desired, when decorating a building, to provide ornamental trim that can be incorporated into an architectural layout to add bold accents to a room without the need for custom fabrication. In buildings with high ceilings or buildings in which the support structure is exposed, problems have arisen in the past when attempting to place signs, lighting and decorative trim at a level that would be most beneficial to the occupants. Typically when architectural designs call for ornamental trim in order to create a desired look, skilled craftsmen need to be retained so custom trim can be fabricated in accordance with the plans. Custom fabricated trim is very costly to create and requires vast amounts of time and labor to reach the desired end product.

Present lighting systems that can be suspended from these high ceilings require the use of special hardware so lighting systems can be lowered from their power supply to provide the required lighting conditions. Custom lighting hardware is expensive and is time consuming to install. Another alternative to provide illumination is to install high intensity lighting near the ceiling that is powerful enough to enlighten the floor below. High intensity lighting is expensive to purchase, consumes a considerable amount of electricity and generates high amounts of heat. An alternative system that can be used to alleviate the need for custom or high intensity lighting is to use suspended ceilings constructed out of a suspension grid and drywall or lay-in acoustical panels. Once the grid work for the suspended ceiling is installed, lighting fixtures such as recessed lighting or track lighting can be installed by attaching the fixtures to the grid work. After the lighting is installed, drywall sections or acoustical panels are attached to complete the ceiling. The electrical hardware that supplies power to the lighting fixtures, such as wiring, conduit and electrical boxes are hidden above the false ceiling out of view from the occupants below. When finishing suspended drywall ceilings, it has been found that a conventional face trim stripping such as COMPASSO™ trim sold by USG Interiors, Inc. can be used to conceal the ends of the ceiling, eliminating the need to trim and finish the edges with drywall, corner bead, "J" bead and finishing compound. To attach the face trim to the edge of the suspended ceiling, clips need to be attached to the grid beams in the suspended ceiling that support the drywall as shown in U.S. Pat. Nos. 5,937,605 and 5,201,787. While suspended ceiling systems provide a good structure for the attachment of lighting and signs, it inhibits the open air feeling that an architect or designer may be trying to create.

It is desirable to design a system that allows for the positioning of standard electrical lighting and signs at elevations that are useful to the buildings occupants while leaving high ceilings or building structure exposed. It is also desirable to design a system that uses existing COMPASSO™ trim strips that can be adapted to allow multiple design configurations to create an aesthetically pleasing trim structure while having the capability of concealing electrical hardware if electrical lighting is used. Prior art trim systems have been used to attach face trim to ceiling edges by connecting clips to the grid system of a suspended ceiling. The prior art however, does not provide for an adjustable trim strip system that can be suspended to provide a stand-alone trim strip structure that can conceal electrical wiring hardware and allow for the attachment of electrical lighting and signs. The present invention incorporates trim strips such as COMPASSO™ trim and adjustable brackets to provide an aesthetically pleasing stand-alone trim structure that can be hung from wires or rods or attached to walls or ceilings in a building structure in numerous configurations.

SUMMARY OF THE INVENTION

The invention is a self supporting adjustable trim strip system that can be suspended from the structure of a building to create the appearance of a floating decorative trim in which lighting or signs can be attached thereto. The trim strip system allows for the placement of a continuous suspended decorative channel configuration that does not need to be connected to a suspended ceiling grid or other structure, but can be suspended from the structure of the building by using existing fastener technology such as hanger wires and rods. The benefit of the present invention is that it allows for the placement of lighting and signs in desired locations and heights without the need to enclose the structure with a false ceiling to hide electrical wiring hardware or mounting brackets. This allows the room to maintain high ceilings while providing usable lighting. The trim strip system also reduces the costs associated with installing a suspended ceiling. Another benefit of the present invention is that since the electrical power supply can be concealed within the trim strip system, it is unnecessary to use costly custom lighting systems that would otherwise be needed to illuminate the room.

The adjustable trim strip system consists of a bracket that can be suspended from a building structure at various points where paired face trim stripping is to be attached or can be directly mounted to walls or ceilings. The bracket allows two outwardly directed face trim pieces, such as COMPASSO™ trim, to be clipped in place along the exterior surface of the suspended brackets creating a continuous channel for concealing electrical hardware. The bracket comprises two trim attaching components which are elongated substantially flat members of a predetermined width that have attachment flanges formed at both ends. The attachment flanges are bent at an angle greater than 90 degrees so that they flare out and provide a biasing force used to hold against flanges of the face trim. The trim attachment brackets are bi-planar and are interconnected by a flat bridge. The entire clip can be formed from a single piece of metal or plastic which is formed into the desired configuration.

The bridge that interconnects the trim attachment clips creates an overall U-shape and provides the rigidity needed to keep the face trim strips parallel to each other. The bridge contains holes positioned in a horizontal arrangement that allow for the attachment of hangers or hanging wire. The holes are arranged to allow for the off center placement of the wire which causes the bracket to lean, altering the overall appearance of the trim strip system. Vertical holes on the bridge are used for the mounting of angle brackets which allow the clip to be attached to a suspension rod or allows two trim strip systems to be fastened together. The angle brackets can also be attached to the lower half of the bridge in order to provide a mounting surface so track lighting and signs can be installed. The top and bottom portions of the bridge can include notches to allow for the passing of electrical hardware. A knock-out is provided to allow connection to an electrical box so electrical service can be provided to a lighting fixture or an illuminated sign. Alternatively, the bracket may be configured to include one trim clip, a bridge member and a wall mount formed from a single piece of metal stock to form a Z-shaped bracket. The Z-shaped bracket is designed to allow for the attachment of a continuous length of trim stripping directly to a wall or ceiling by installing fasteners in the apertures located on the wall mount. If it becomes desirable to mix the heights of the trim stripping, an alternative split bracket can be used that provides for two L-brackets attached together by fasteners to form a split bridge. The split bridge can be widened or narrowed by sliding the brackets inward or outward, aligning the apertures on the bridge and installing the fasteners. The bridge can alternately be assembled in a "V" configuration by fastening the split bridge together so the upper half of the combined bridge is wider than the lower half of the bridge which allows for the installed trim panels to display an angled outward appearance.

To enclose the bottom of the trim strip system, which conceals any wires or brackets, an inverted U-shaped channel constructed of metal or plastic can be inserted into the lower notch of the bridge with the lower edges of the inverted "U" positioned on the flanges of the trim attachment brackets. The inverted U-shaped channel can be a continuous length of material interrupted only to allow the passage of a downwardly extending sign or illumination fixture, or can be a segmented structure if desired.

If it becomes necessary to connect two trim strip systems at an intersection, a hub may be incorporated to allow for the joining of two or more intersecting systems. A hub would be used to join a comer in a square strip system or may provide for a three-way or a four-way intersection if the trim strip is arranged in a grid format. To create a comer, two trim clips are fastened to a pair of hubs in a 90 degree fashion. The trim strip on the outer most surface is extended until both sections meet, concealing the comer. To aid in suspension, the hub contains a 90 degree upwardly facing tab that allows for the attachment of a wire that extends to the structure of the building. Alternatively, if it is necessary to create an intersection with an angle less than 90 degrees, a triangle spacer can be used to create smaller angles.

BRIEF DESCRIPTION OF THE DRAWINGS

FIG. 15 is a cross-sectional view of the adjustable trim strip system with the hanger clip attached with a wire yoke to raise the attachment point to the top of the bracket and allowing conduit to pass between.

DETAILED DESCRIPTION OF THE INVENTION

Figure 2:
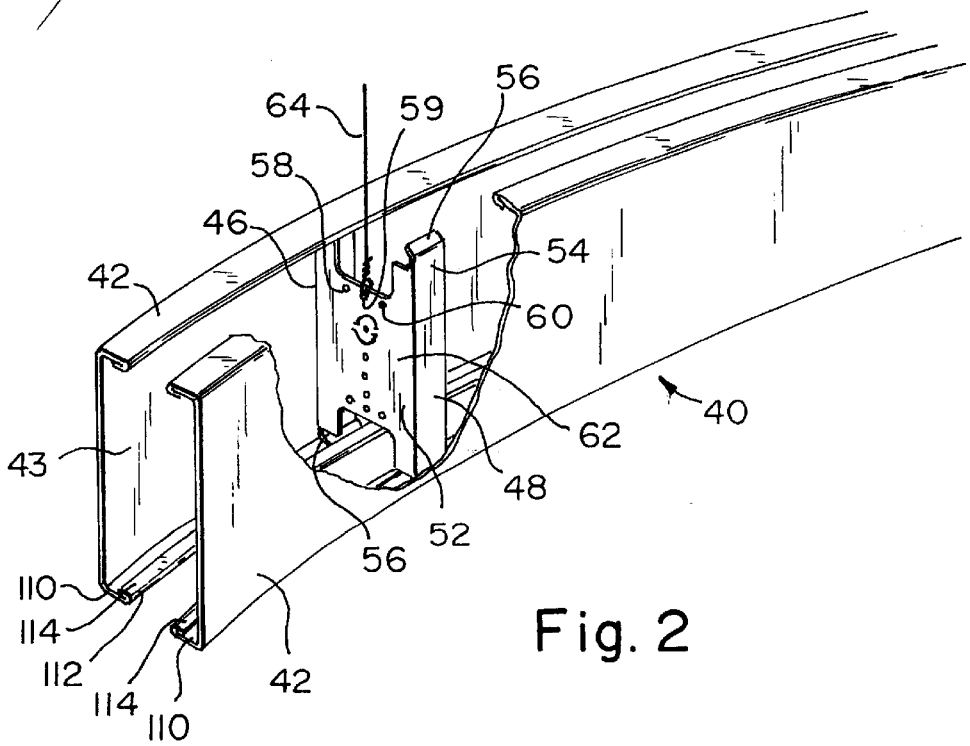
FIG. 2 is a detailed perspective view of a segment of FIG. 1 showing a bracket mounted in a typical configuration to a pair of trim strips where one of the trim strips is cut away to show the positioning of the bracket. The bracket is shown with a hanger wire attached to one of the holes in the bride. The bridges contains two notches.
Figure 3:
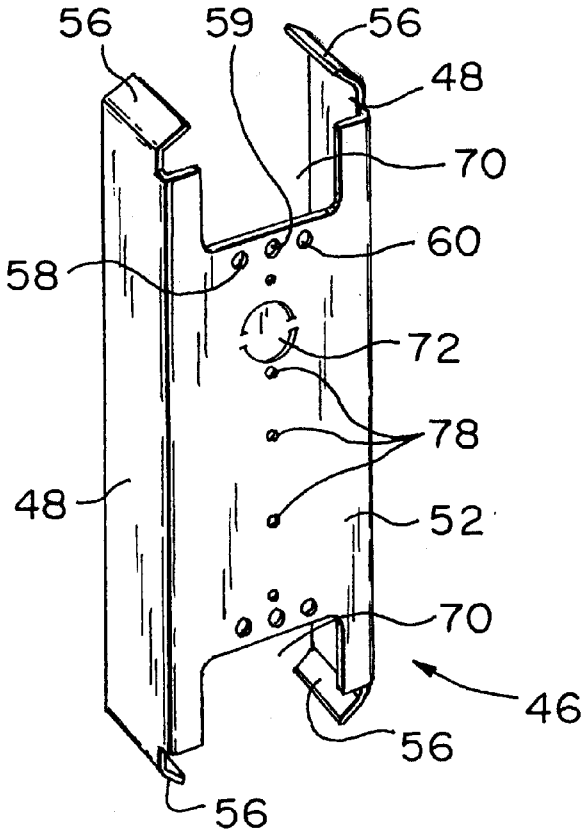
FIG. 3 is a perspective view of the basic U-shaped bracket shown with two trim clips with retaining flanges. The bridge connecting the two trim clips contains a knock-out for electrical as well as holes for attaching a hanger wire.
Figure 10:
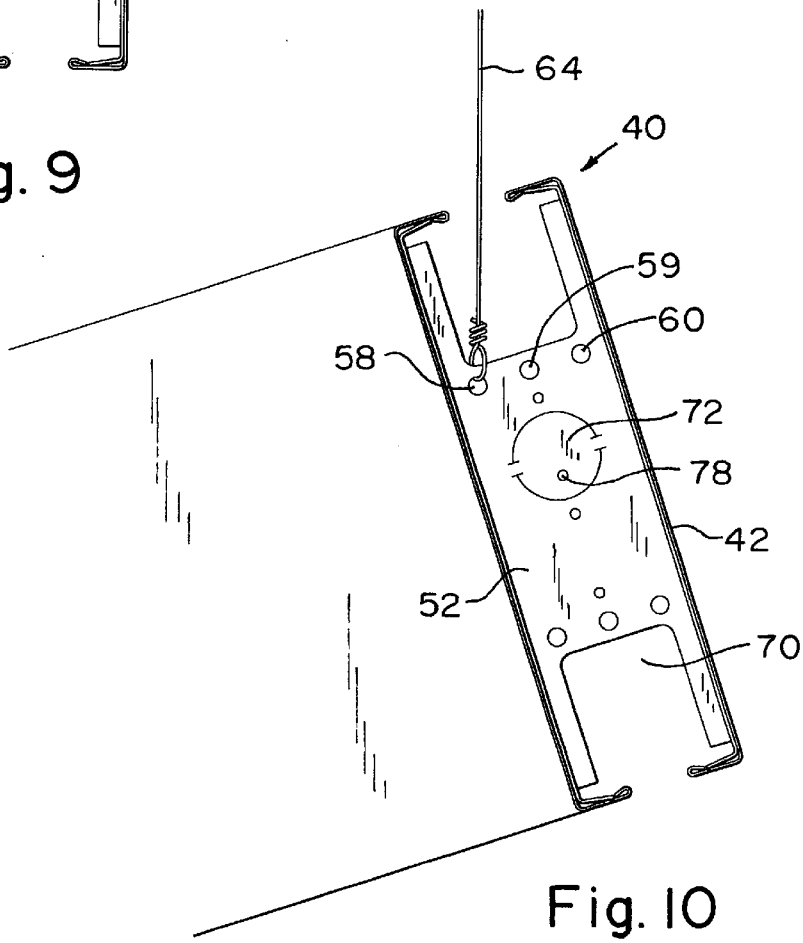
FIG. 10 is a cross-sectional view of the adjustable trim strip system shown in an angled installation.
Figure 15:
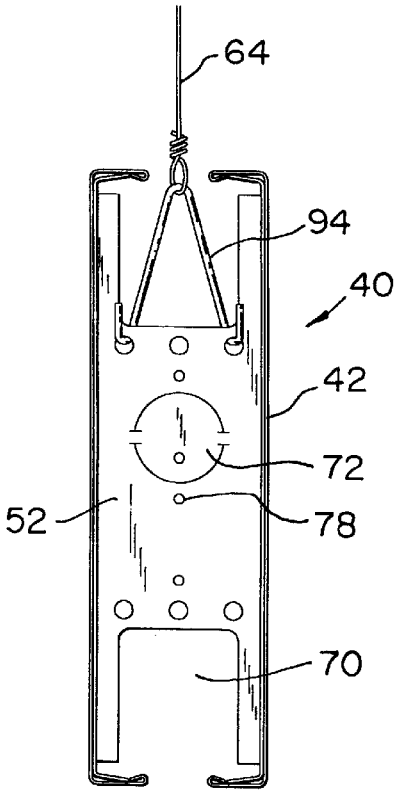

The adjustable trim strip system 40 of the present invention essentially comprises a pair of outwardly facing trim strips 42, and a U-shaped bracket 46 with trim clips 48 separated by a bridge 52 as depicted in FIG. 2. The U-shaped bracket 46 is preferably formed from sheet metal but can be made out of plastic. The trim clips 48, as shown in FIG. 2, have a planar face surface 54 and trim attachment flanges 56 located at the upper and lower edges of the planar face surface 54. The trim attachment flanges 56 are bent at an angle greater than 90 degrees with respect to the planar face surface 54 to provide a clip biasing force against the inner surface 43 of the trim strip 42. The planar face surface 54 of the trim clips 48 provide a load bearing surface for the inner surface 43 of the trim strip 42 when attached to the bracket 46. The trim clips 48 are interconnected by a bridge 52 which maintains the trim clips 48 in spaced apart parallel planes. The bridge 52 contains a plurality of holes 58–60 that are horizontally positioned across the planar surface 62 of the bridge 52. The holes are sized to allow the attachment of a hanger wire 64 that extends upward to the building structure. Depending on the hole position selected for attachment of the hanger wire 64, the bottom of the trim strip system will appear either parallel to the floor or angled to the right or left. Angled installation, as shown in FIG. 10, is accomplished by placing the hanger wire 64 in either hole 58 or 60 and is typically used when the trim strip system is arranged in a ring format. If the hanger wire 64 attachment point needs to be raised to the top of the bracket 46 for ease of installation or stability, a wire yoke 94 which is an inverted V-shaped wire that can be inserted into the outer most holes 58 and 60 as shown in FIG. 15. FIG. 3 shows a detailed illustration of the bridge 52 which further includes at least one notch 70, a knock-out 72 and a plurality of vertically extending holes 78.

Figure 11:
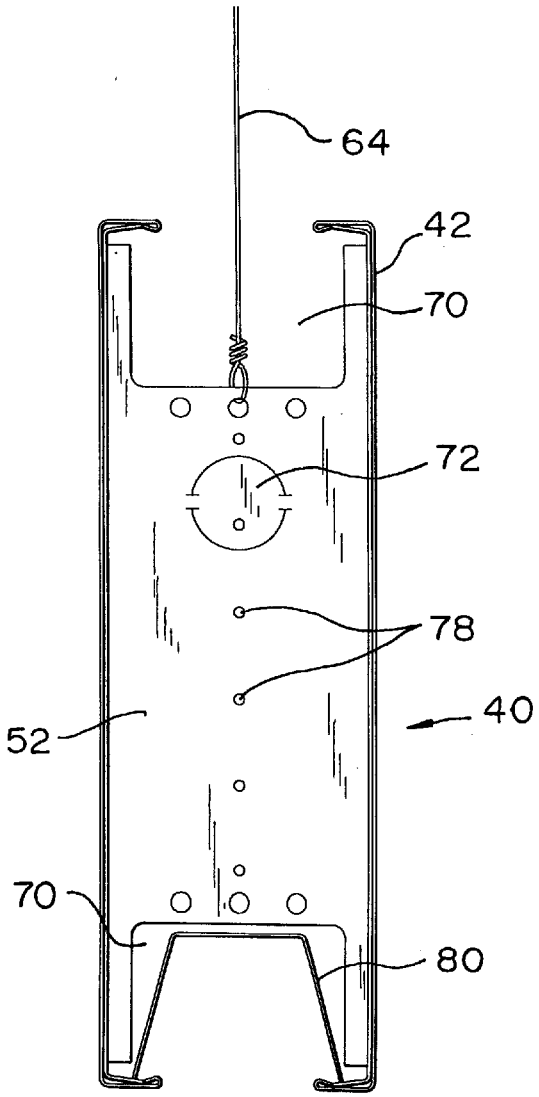
FIG. 11 is a cross-sectional view of the adjustable trim strip system with an inverted U-channel at the bottom to close off the brackets.

The notches 70 are located at the top and bottom of the bridge 52 and allow for the passage of electrical wiring, conduit and the like. The notch 70 located at the bottom of the bridge 52 allows for the attachment of a bottom trim strip 80 as shown in FIG. 11 and is used to close off the bottom of the channel formed by the trim strip system 40. The bottom trim strip 80 conceals the brackets 46 and all electrical hardware from view.

The knockout 72 is provided to allow for the passage of conduit fittings and wiring when an electrical box is attached to the bridge 52 to provide power to a lighting fixture. The electrical box is connect to the bridge 52 by using fasteners and positioned so the knock-out located on the electrical box is aligned with the knock-out located on the bridge 52.

Figure 4:
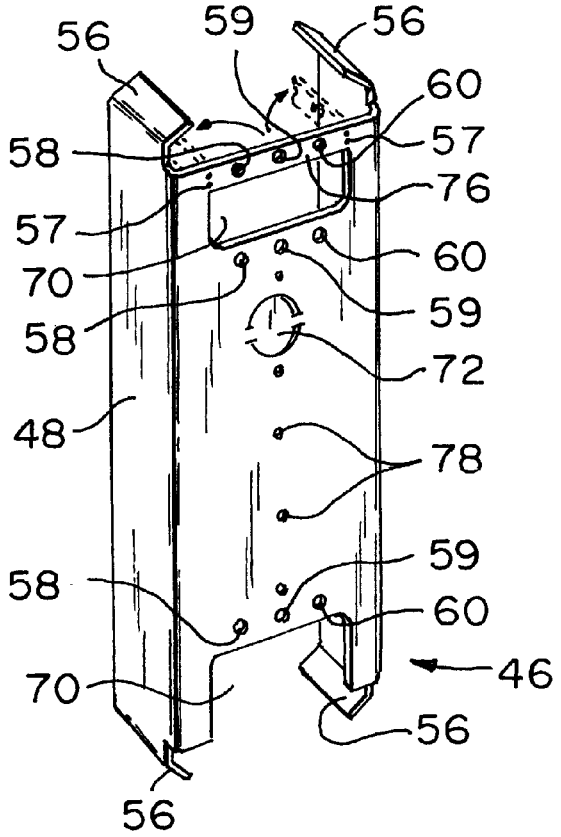
FIG. 4 is a perspective view of the preferred U-shaped bracket with a link across one of the notches that can be cut at the center and folded outward.
Figure 6:
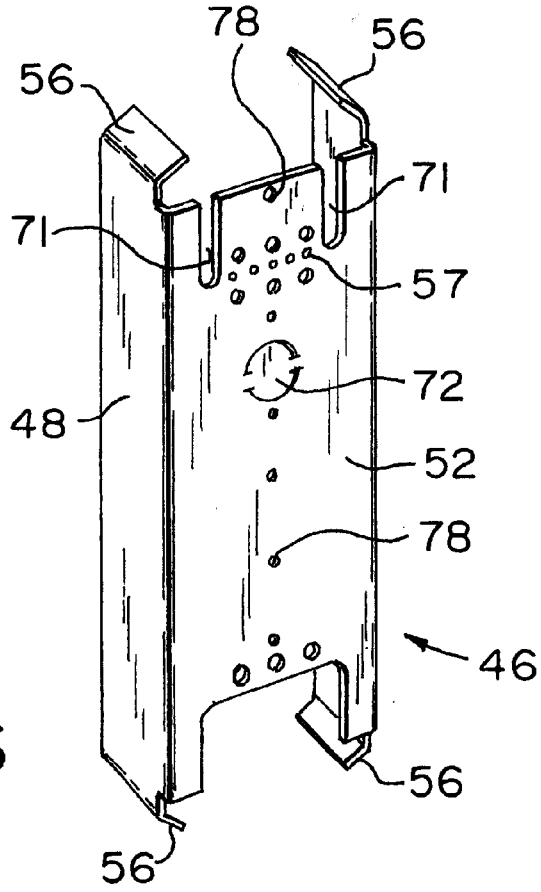
FIG. 6 is a perspective view of an alternate embodiment of the U-shaped bracket with the top of the bridge incorporating a tab that can be bent downward for clearance at the top if required.

Alternatively, a tab 74, shown in FIG. 6, or a breakable link 76, shown in FIG. 4, can be added to the bridge 52 to allow the hanger wire 64 to be fastened at the top of the bracket 46. The tab 74 or breakable link 76 can be manipulated to allow for clearance at the top for the passage of the electrical hardware. The breakable link 76, as shown in FIG. 4, is positioned at the upper edge of the bridge 52 and spans across notch 70. The breakable link 76 contains apertures 58–60 to allow for the attachment of a hanger wire 64 and also includes weakened zones 57 which allow the breakable link 76 to be bent outwardly after the center has been severed. The tab 74, shown in FIG. 6, includes a plurality of apertures 78 to allow the bracket 46 to be attached to the wire hanger 64. The tab 74 also contains a weakened zone 57 along its base which allows the tab 74 to be easily bent downward if clearance is need for the passage of electrical hardware such as conduit.

The preferred embodiment of the bracket 46, shown in FIG. 4, is similar to the other brackets in that it is of a unitized construction and is formed of a section of sheet metal to produce a structure that includes apertures 58–60, notches 70, breakable link 76, knock-out 72, vertical apertures 78 as well as the overall bracket configuration. The bridge 52 and the trim clips 48 are formed by bending the trim clips 48 inwardly until they are perpendicular to the bridge 52. It is this configuration that gives the U-bracket 46 its U-shaped appearance. Once the two trim clips 48 are formed, flanges 56 are created by bending the upper and lower edges of the trim clip 48 until an interior angle is formed in excess of 90 degrees. FIG. 4 is the preferred embodiment since it incorporates the breakable link 76 that allows for the attachment of the hanger wire 64 at the upper most position on the bracket 46, while allowing the link 76 to be severed and bent outwardly to allow the passage of electrical hardware if so required.

Figure 35:
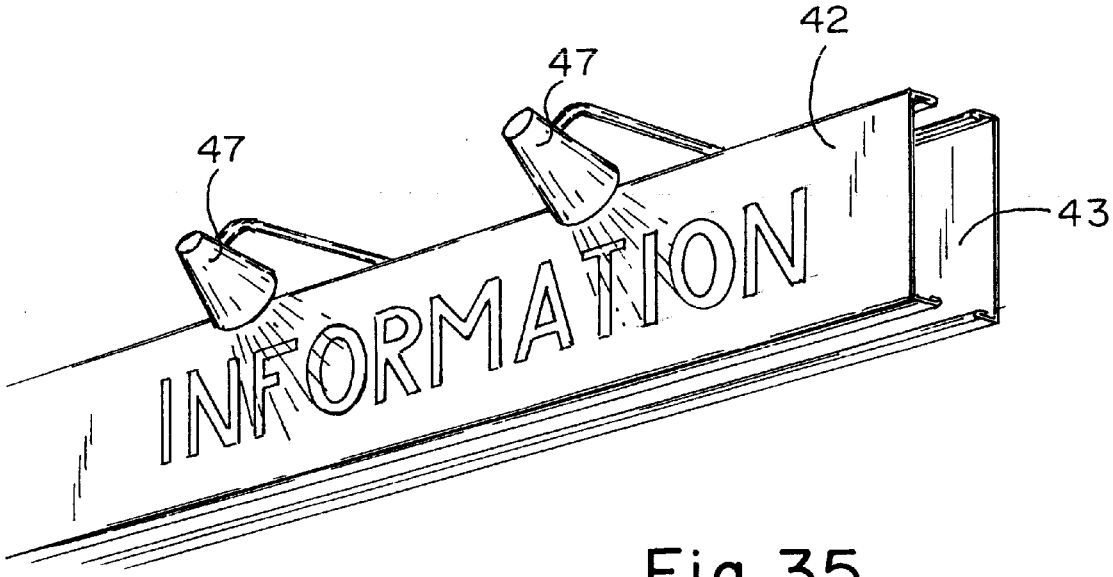
FIG. 35 is a perspective view of the adjustable trim strip system where a sign is lettered on the face of the trim stripping with illumination overhead.
Figure 36:
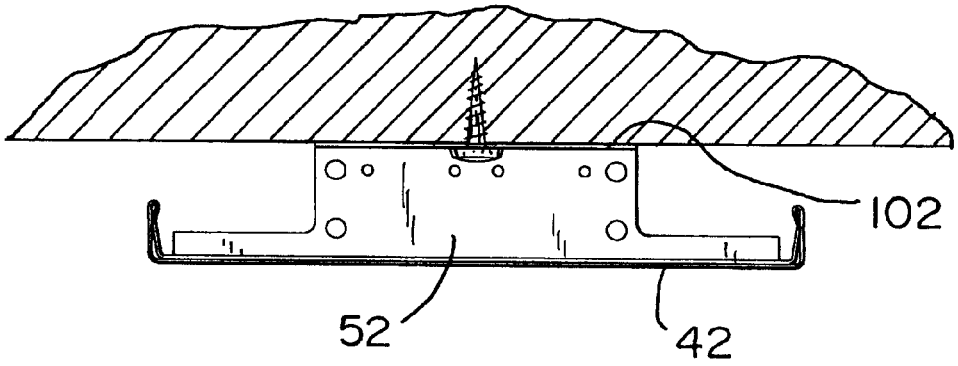
FIG. 36 is a cross-sectional view of an alternate embodiment of the adjustable trim strip system with the Z-bracket and trim stripping attached to a ceiling.
Figure 37:
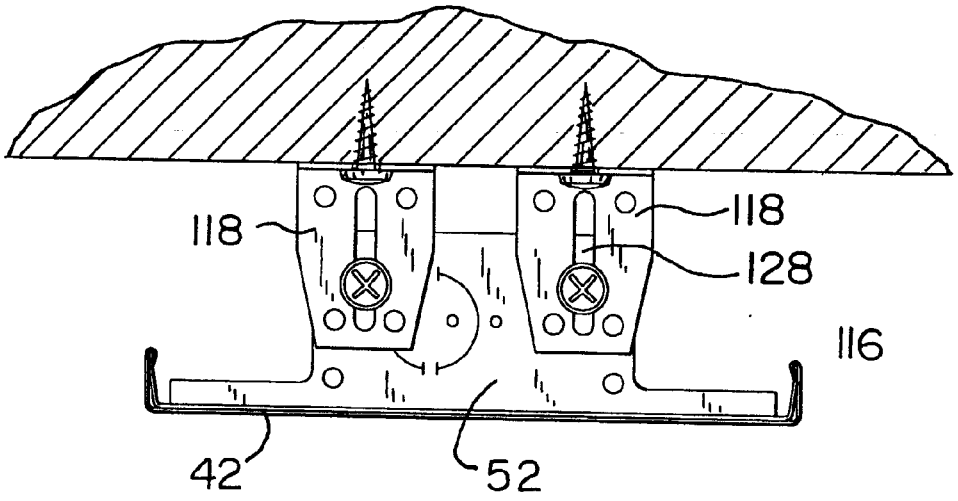
FIG. 37 is a cross-sectional view of an alternate embodiment of the adjustable trim strip system wit the L-bracket incorporating angle brackets to attach trim stripping to a ceiling.

Trim strip 42 is a face trim such as COMPASSO™ trim as shown in FIG. 2. The trim 42 can be manufactured in various lengths and widths and can be produced from materials such as aluminum, steel or plastic. The exterior surface of the trim 42 can be produced in a variety of colors and textures and can be used to display signs as shown in FIG. 35. The trim 42 is of a channel shaped configuration with flanges 110 that run along the length of the trim. The COMPASSO™, or other face trim, can be shaped to follow the contour of the ceiling edge or other shapes to follow architectural design. The COMPASSO™ 42 has upper and lower inturned flanges 110 that run along the length of the trim 42. Leading edges 112 of the flanges 110, best viewed in FIG. 2, are bent back inwardly to form rebates 114. The COMPASSO™ trim 42 is mounted to the trim clip 48 by snapping the leading edges 112 of flanges 110 of the COMPASSO™ trim 42 over the attachment flanges 56 of the trim clips 48 of the bracket 46. Another section of COMPASSO™ trim 42 is similarly mounted to the second trim clip 48 that is separated by the first trim clip by bridge 52. Once the COMPASSO™ trim sections 42 are attached to the first and second trim clips 48, the entire assembly can be elevated to the desired height and the brackets 46 can be attached to the hanger wires 64 by inserting the wire 64 through one of the apertures 58–60 in the bridge 52 and twisting the wire 64 upon itself to make a secure connection. Alternatively, the brackets 46 can be pre-hung to the desired height and properly spaced apart before the COMPASSO™ trim 42 is attached. Once the brackets 46 are properly positioned, the leading edges of the COMPASSO™ trim 42 can be snapped over the attachment flanges 56 of the trim clips 48.

Figure 23:
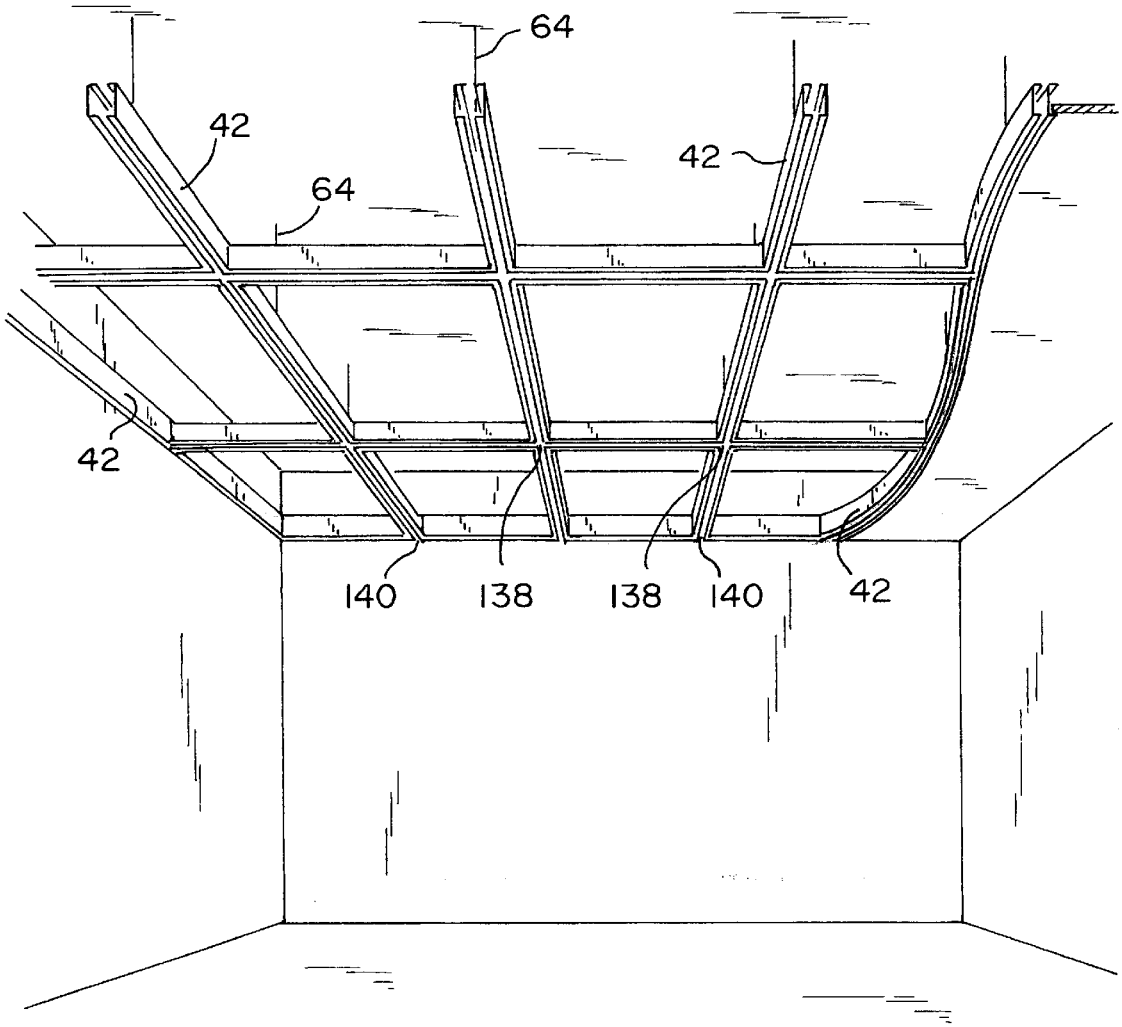
FIG. 23 is a perspective view of a room with the adjustable trim strip system arranged in a grid with four way intersections and attached to two walls and a ceiling cap.

Depending on the application, it may be necessary to converge two or more strips at an intersection. The adjustable trim strip system 40, shown in FIG. 23, is a large grid arrangement that includes several four way intersections 138 and three way intersections 140. The central portion of the grid system consists of paired COMPASSO™ trim 42 while the trim 42 along the walls and the capped ceiling section only incorporates singular strips of trim. The intersections are formed by attaching U-shaped brackets 46 to hubs 82 as shown in FIG. 28. The COMPASSO™ trim 42 is attached to the walls and ceiling in FIG. 23 by using either a Z-bracket 100 of FIG. 7 or an L-bracket 116 of FIG. 27, with angle brackets 118. The entire grid system is supported by attaching hanger wires 64 or rods (not shown) from the brackets 46 and hubs 82 to the structure of the building. To create an intersection, a pair of hubs 82, as shown in FIG. 28, are used to allow for the attachment of one or more hangers 46. The hubs 82 include a body 83 with a top surface 84, a bottom surface 86 and four identical side edges 88. The side edges 88 are essentially extensions of the body 83 that have been folded upward from the body of the hub at a 90 degree angle. The side edges 88 contain a plurality of holes 85 that are sized to allow for the attachment of the brackets 46 with the use of fasteners. The hub 82 is dimensionally square in shape, as shown in FIG. 28, and is sized to accommodate the width of the bracket 46. If a four-way intersection is desired, four brackets 46 can be fastened to each side edge 88 of the hub 82. To complete the intersection, two hubs 82 are used wherein one hub 82 is attached to the top and the other to the bottom of the bracket bridge 52. The top surface 84 of the hub 82 includes a centrally positioned tab 90. The tab 90 is created by bending a section of the body 83 upwards 90 degrees from the body 83. The tab 90 contains an aperture 92 to allow for the attachment of the hanger wire.

Figure 7:
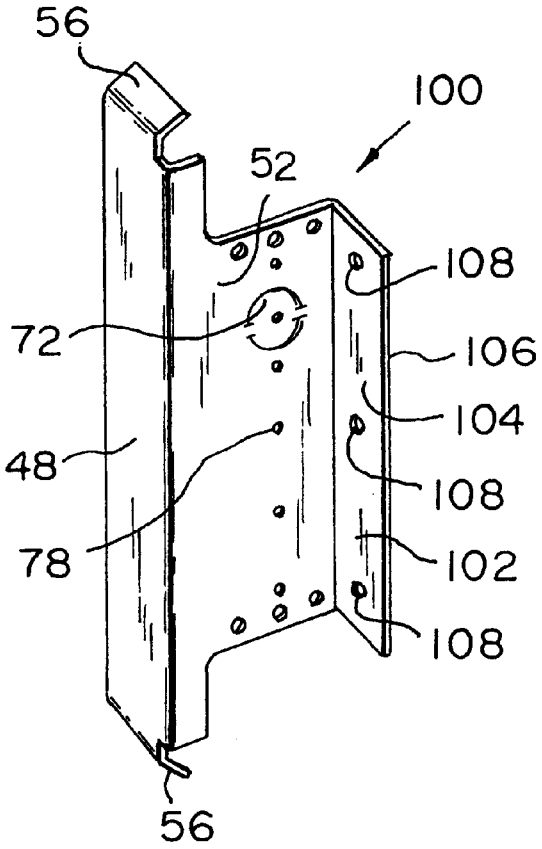
FIG. 7 is a perspective view of a Z-bracket with one side adapted to be mounted to a trim strip and the other adapted to be mounted to a wall.
Figure 24:
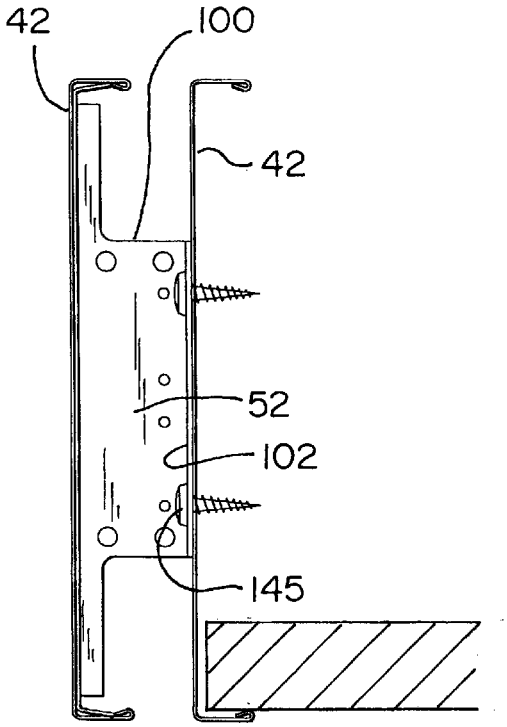
FIG. 24 is a cross-sectional view of an alternate embodiment of the adjustable trim strip system with the Z-bracket attached to the face of conventional COMPASSO™ which is capping a ceiling edge.
Figure 25:
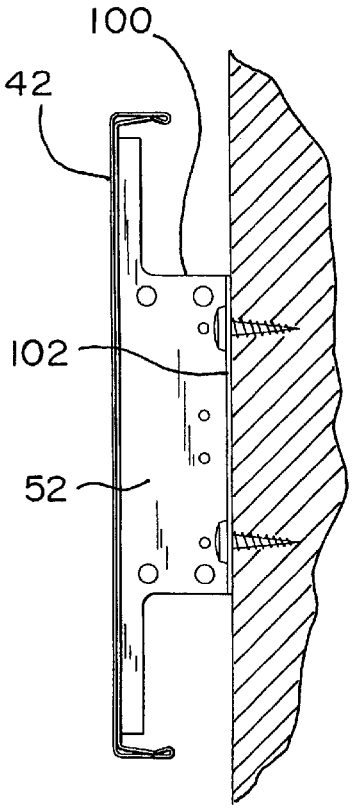
FIG. 25 is a cross-sectional view of an alternate embodiment of the adjustable trim strip system with the Z-bracket used to attach trim stripping to the face of a wall.

If it becomes desirable to fasten the trim strip to a wall, a ceiling or a COMPASSO™ ceiling edge cap, a Z-bracket 100 can be used as shown in FIGS. 24 and 25. The Z-bracket 100 best shown in FIG. 7 is similar to the U-shaped bracket 46 except that it only has one trim clip 48. The Z-shaped bracket 100 further includes a wall mount 102 separated from the trim clip 48 by a bridge 52. The wall mount 102 includes a front surface 104 and a back surface 106 which are planar. The wall mount 102 is attached to the bridge 52 at one edge and perpendicularly oriented so as to form a right angle to the bridge 52. The wall mount 102 further includes a plurality of holes 108 to allow the clip to be attached to a wall by the use of fasteners. The bridge 52 of the Z-bracket 100 can also include a knockout 72, horizontal apertures 58–60 and vertical apertures 78. Once the Z-bracket 100 is fastened to the wall, the trim strip 42 can be pressed onto the trim clip 48 and snapped into position as shown in FIG. 25. Alternatively, the Z-bracket 100 can be used to attach a COMPASSO™ trim section 42 to an existing ceiling edge cap as shown in FIG. 24. The Z-bracket 100 can be attached to the edge cap by placing the wall mount 102 against the face of the capping material and using fasteners to attach it thereto.

Figure 1:
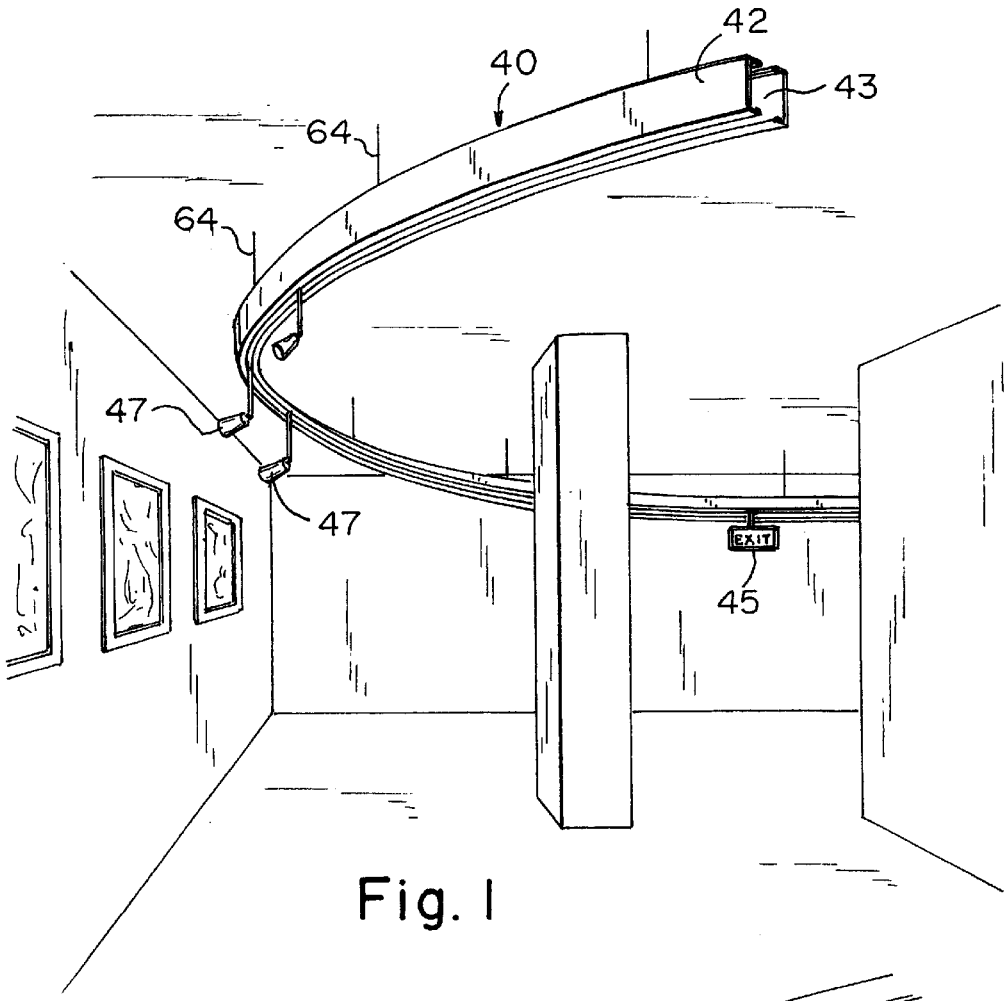
FIG. 1 is a perspective view of the adjustable trim strip system.
Figure 5:
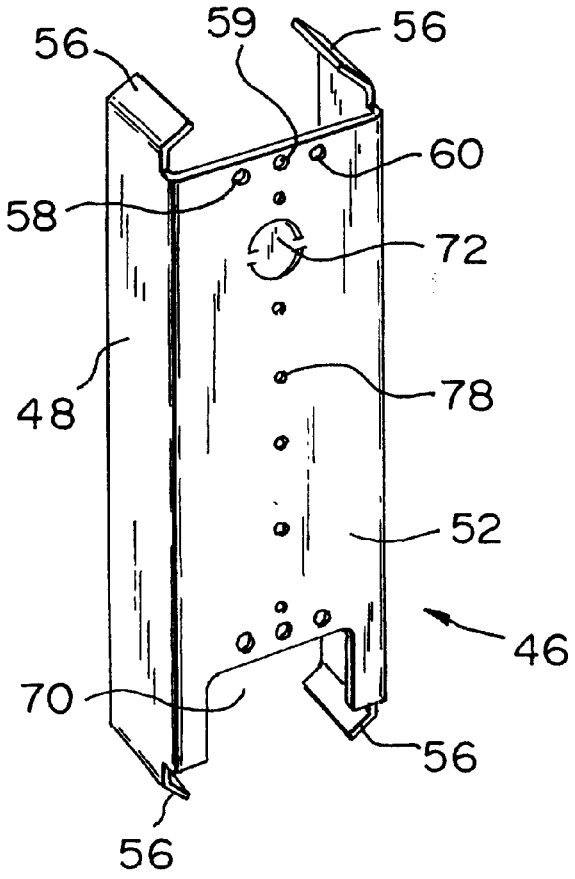
FIG. 5 is a perspective view of an alternate embodiment of the U-shaped bracket with the bridge extending to the top of the bracket.

FIG. 1 shows a mounted trim strip system 40 with paired COMPASSO™ trim 42 placed in a curvilinear arrangement. The trim strips 42 are connected to U-brackets 46, not shown, that are suspended from the ceiling of the room with hanger wires 64. Lighting 47 and a sign 45 can be attached to the system 40 to provide lighting at specific locations. Referring to FIG. 3, a basic U-shaped bracket 46 is shown with a right side and left side trim clip 48 with flanges 56 and bridge 52. The bridge 52 has an upper and lower notch 70, hanger holes 58–60, vertical holes 78 and knock-out 72. FIG. 4 is similar to FIG. 3 but further includes the preferred breakable link 76 that allows the hanger wire 64 (not shown) to be connected closer to the top of the trim strip system 40 which allows for extra spacing so electrical boxes can be installed. If the breakable link 76 is not needed or prevents the passage of electrical hardware, the link 76 can be snipped in the middle of the link 76 and folded outward to provide the additional clearance needed as indicated by the shadow drawings. FIG. 5 shows a hanger 46 that only includes a notch 70 on the lower section of the bridge 52 with the hanger holes 58–60 running across the top of the bridge 52. In an alternative embodiment shown in FIG. 6, the top of the bridge can contain two vertically extending slots 71 to create a bendable tab 74 to allow for a higher attachment point of the hanger wire 64. If the tab 74 is not needed or impedes the passage of electrical hardware, the tab 74 can be bent downward to provide the needed clearance.

Figure 8:
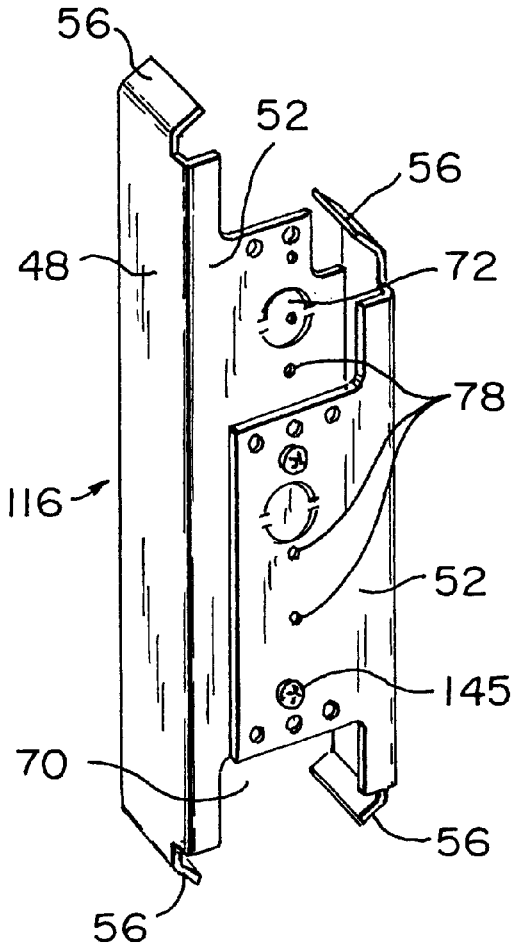
FIG. 8 is a perspective view of two L-shaped brackets of different sizes attached at the bridge to allow the mounting of two separate size pieces of trim.
Figure 9:
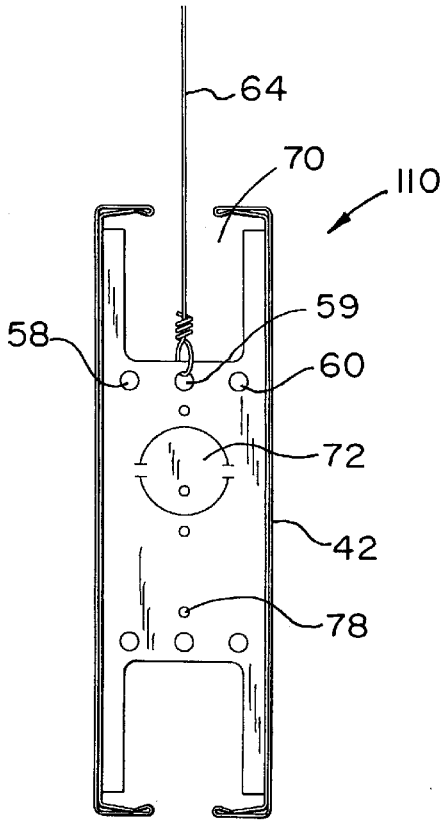
FIG. 9 is a cross-sectional view of the adjustable trim strip system with the U-shaped bracket attached to two trim pieces and supported by a hanger wire.
Figure 12:
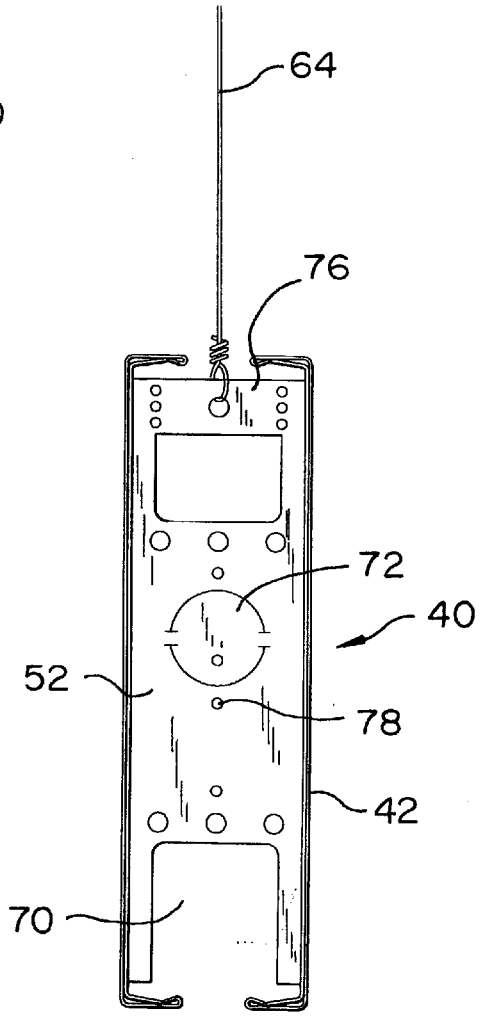
FIG. 12 is a cross-sectional view of the preferred adjustable trim strip system shown supported by a hanger wire attached to the link across the bridge notch at the top of the bracket.
Figure 13:
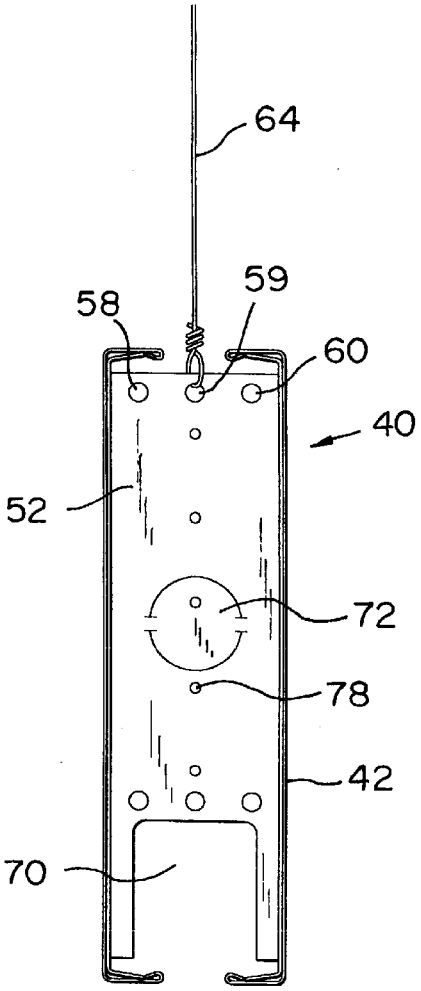
FIG. 13 is a cross-sectional view of an alternate embodiment of the adjustable trim strip system without a notch at the top of the bridge.
Figure 14:
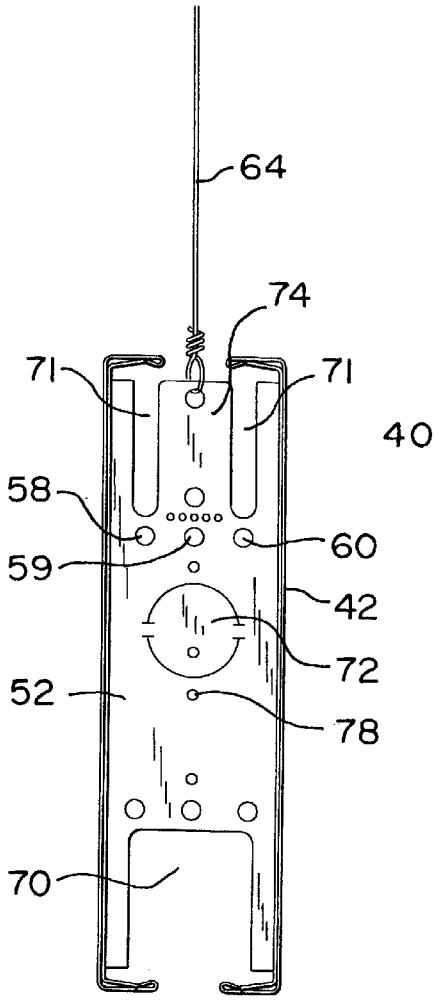
FIG. 14 is a cross-sectional view of an alternate embodiment of the adjustable trim strip system with a tab ed bracket wherein the tab can be folded to allow for the passage of wires.

FIG. 8 illustrates two L-brackets 116 that allows for the mixing of COMPASSO™ trim 42 of different heights and widths. The L-shaped brackets 116 are attached by fastening the bridges 52 of the brackets 116 together with sheet metal screws through the vertical holes 78. Different holes may be used to narrow or widen the combined bridge 52 or to create a flared top section. FIGS. 9–10 show the effect that the placement of the hanger wire 64 has on the positioning of the trim strip system 40. FIG. 9 depicts the hanger wire 64 in the center hole 59 on the bridge 52 which orients the system in a vertical position. In FIG. 10, the hanger wire 64 is in the left position 58 which allows the hanger wire 64 to pass vertically between flanges 110 when the trim strip system 40 is tilted or leaned to one side, leaving the bottom left comer of the system 40 lower than the bottom right. Alternatively, if the hanger wire 64 was tied to the right position 60, not shown, the hanger would pivot in the opposite direction. FIGS. 12–15 show alternate embodiments that allow the hanger wire 64 to be attached at the upper most point of the trim strip system 40. Each embodiment performs the same function but provides different advantages depending on the installation. All but FIG. 13 allow for the passage of electrical hardware through an opening in the top of the bridge 52. FIG. 12 shows the hanger wire 64 attached to an aperture in the breakable link 76. FIG. 13 illustrates a bracket 46 without a notch on the top of the bridge 57.

Figure 16:
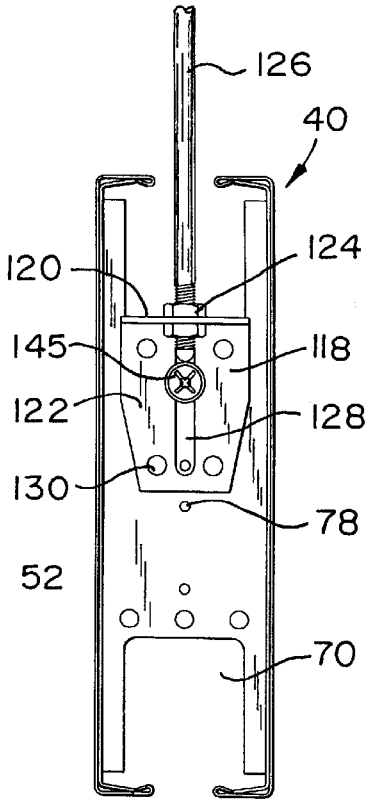
FIG. 16 is a cross-sectional view of the adjustable trim strip system with an angle bracket attached to the U-bracket to allow suspension by a vertical rod.
Figure 17:
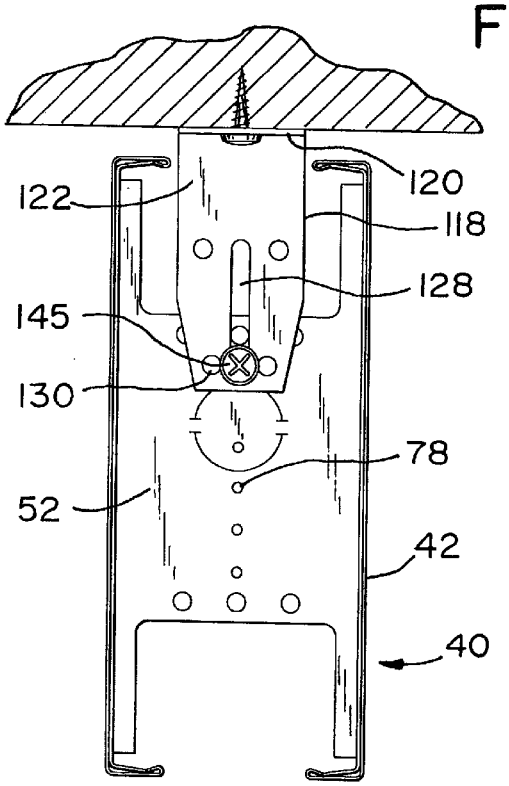
FIG. 17 is a cross-sectional view of the adjustable trim strip system with an angle bracket attached to the U-bracket so the system can be attached to a ceiling.

FIGS. 16–19 depict alternative mounting arrangements of the trim strip system 40 with the addition of angle brackets 118 attached to the hanger bridge 52. The angle brackets 118 are L-shaped brackets with a short leg 120 and a long leg 122. The short leg 120 is perpendicular to the long leg 122 and contains one or more apertures 124 for the passage of a metal hanger rod 126 or a fastener. The long leg 122 contains a vertically extending slot 128 and a plurality of apertures 130 to allow for variable positioning on the hanger bridge 52. FIG. 16 shows an angle bracket 118 with the long leg 122 attached to the bridge 52 by a fastener 145 inserted into the vertical slot 128. A vertically extending threaded hanger rod 126 is shown attached to the short leg 120 of the angle bracket. The threaded rod 126 may be used over the hanger wire 64 if stability of the trim strip system is of a concern. In certain situations, a threaded hanger rod 126 may be preferred over the hanger wire 64 because of the increase load bearing capacities and a more rigid attachment to the building structure. FIG. 17 shows the angled bracket 118 attached by the vertical slot 128 to a vertical mounting hole 78 of the bridge 52 by the use of a fastener 145. The short leg 120 of the angle bracket 118 is attached to the ceiling which allows for the attachment of the COMPASSO™ trim 42 within very close proximity to the ceiling surface to hide the brackets 118.

Figure 18:
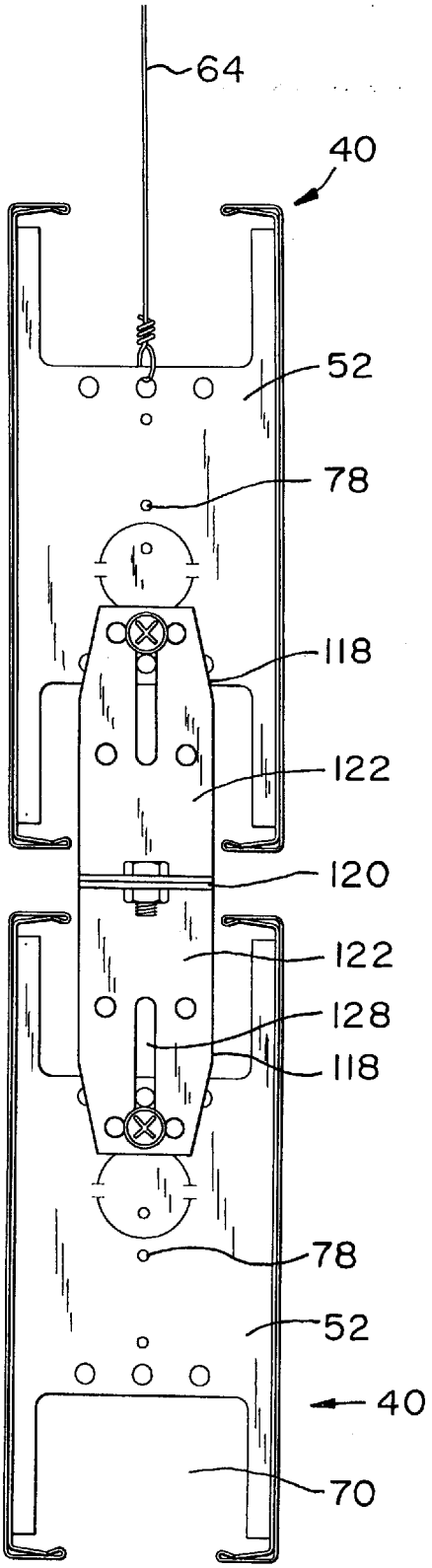
FIG. 18 is a cross-sectional view of the adjustable trim strip system shown with two systems bolted together by use of two angle brackets.
Figure 19:
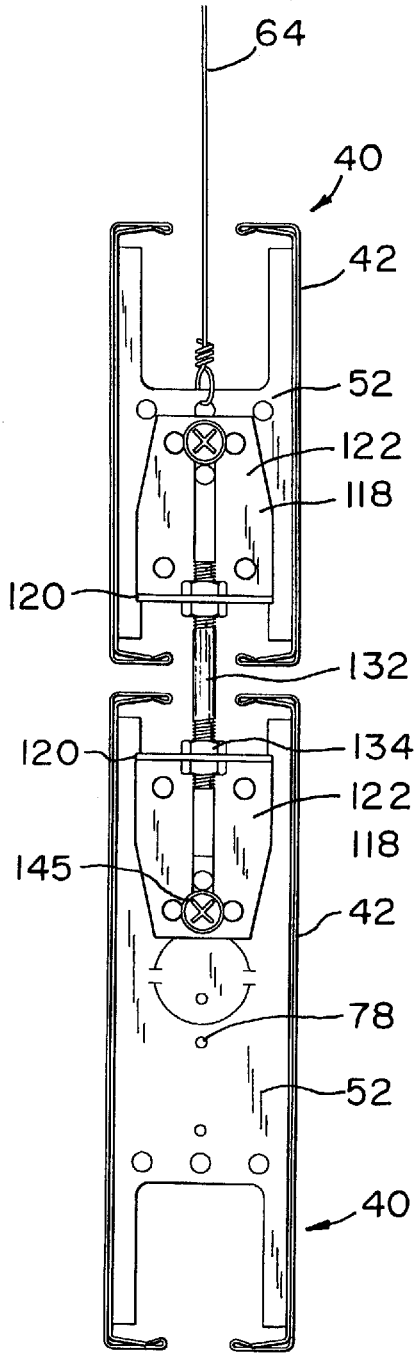
FIG. 19 is a cross-sectional view of the adjustable trim strip system shown with two systems of different heights connected by using threaded rod bolted to two angle brackets.

In some instances, it may be necessary to attach several trim strip systems 40 together to form a single unit as shown in FIGS. 18 and 19. The trim strip systems 40, as shown in FIG. 18, are fastened together by the use of two angle brackets 118 fastened together by the short legs 120 of the angle brackets 118. The long legs 122 of the angle brackets 118 are attached to the bridges 52 of the brackets 46 through the elongated slot 128. By using the elongated slots 128, it is possible to slide the trim strip systems 40 close enough together to eliminate the space between the systems to hide the angle brackets 118. FIG. 19 depicts trim strip systems 40 of different heights fastened together by the use of a threaded rod segment 132 and a pair of angle brackets 118. The angle brackets 118 are attached to the bridge 52 of the bracket 46 by passing a fastener through the vertical slot 128 of the long leg 122 of the angle bracket 118. The threaded rod segment 132 is inserted into the apertures 124 of the short legs 120 of the angle bracket 118 and locked into place by using a pair of threaded nuts 134. The nuts 134 are oriented so one is on each side of the short leg 120 and locked by tightening. Once the two trim systems 40 are fastened together, the entire assembly can then be hung by a hanger wire 64 or a hanger rod, not shown.

Figure 20:
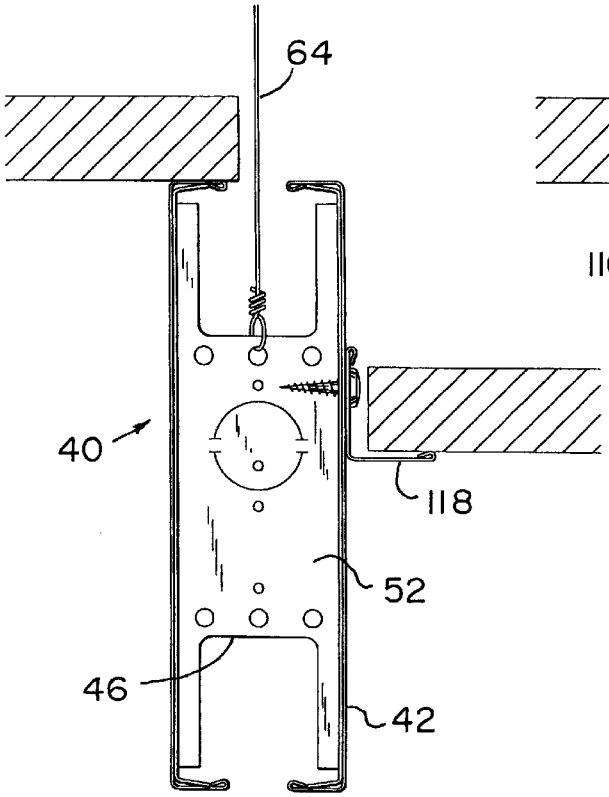
FIG. 20 is a cross-sectional view of the adjustable trim strip system shown at a two-level ceiling intersection beam with one ceiling attached to the face of the trim stripping.
Figure 21:
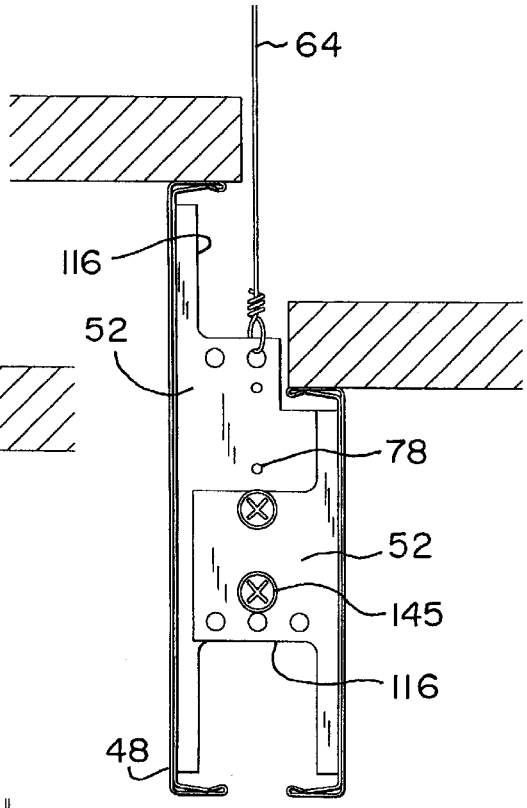
FIG. 21 is a cross-sectional view of an alternate embodiment of the adjustable trim strip system shown at a two-level ceiling intersection using a bracket with a split bridge to allow for narrow gap adjustment.
Figure 22:
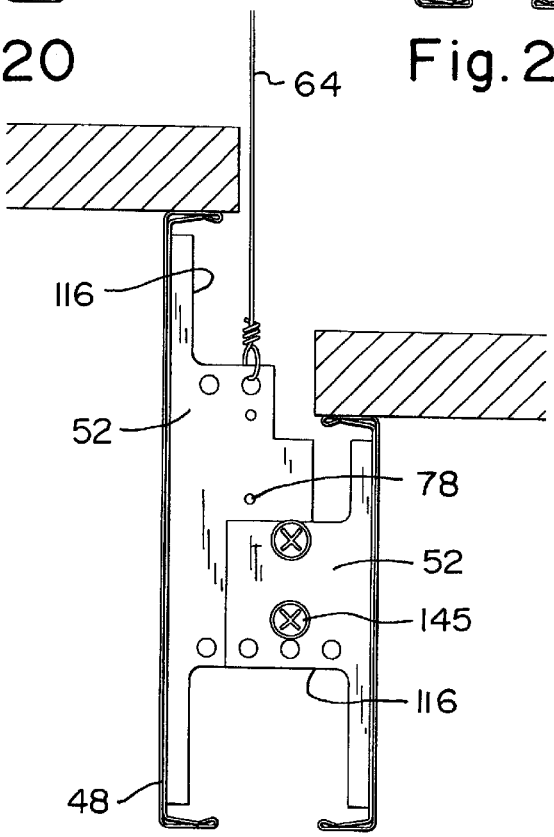
FIG. 22 is a cross-sectional view of an alternate embodiment of the adjustable trim strip system shown at a two-level ceiling intersection using a bracket with a split bridge to allow for a wider gap adjustment.

In situations where two different ceiling heights meet, it is possible to incorporate the present trim strip system 40 as a transition between elevations as well as provide structural support to the ceiling ends as shown in FIGS. 20–22. FIG. 20 depicts a U-bracket 46 with COMPASSO™ trim 42 attached to the trim clips 48. To transition the differential ceiling height, the top of the left COMPASSO™ trim section 42 is placed underneath the higher ceiling elevation. To allow attachment to the lower ceiling section, a conventional angle molding 118 is fastened to the face of the right COMPASSO™ trim section 42 which provides a ledge for the lower ceiling elevated to be situated. The trim strip system 40 is held in place by use of a hanger wire 64 which maintains a tight fit between the trim system 40 and the ceiling sections. FIGS. 21 and 22 depict a pair of L-brackets 116 with different trim clip 48 heights adjustably attached at their bridge sections 52 to allow for alterations of trim spacing. Depending on the width of the span between ceiling sections, it is possible to vary the width of the trim strip system 40 to provide for a transition between elevations.

Figure 26:
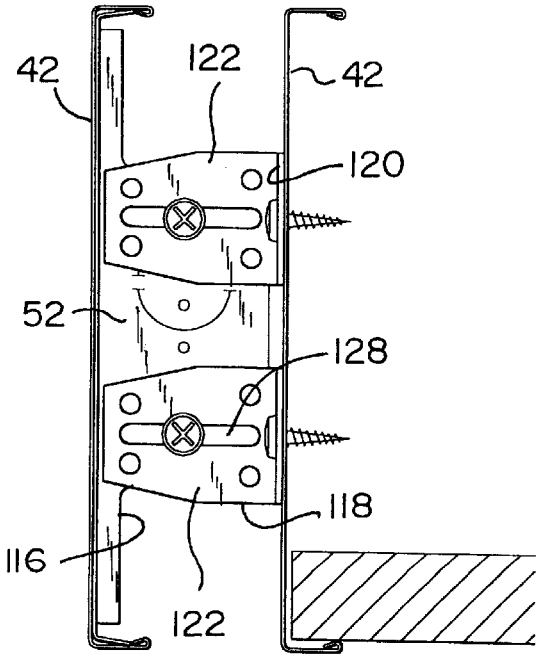
FIG. 26 is a cross-sectional view of an alternate embodiment of the adjustable trim strip system with an L-bracket and trim stripping attached with angle brackets to a conventional COMPASSO™ ceiling cap.
Figure 27:
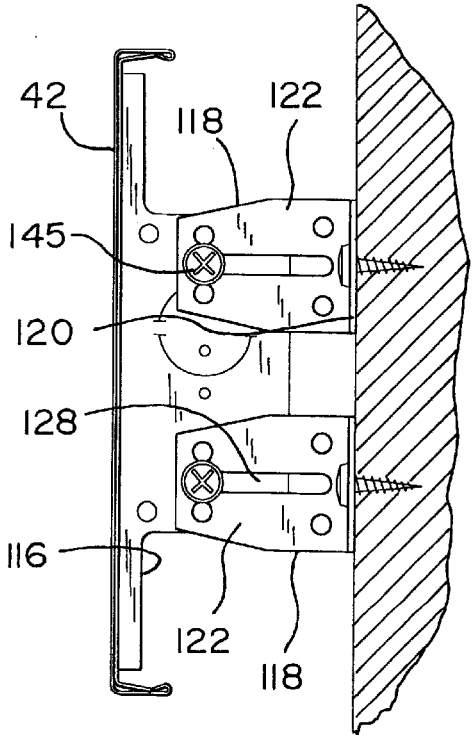
FIG. 27 is a cross-sectional view of an alternate embodiment of the adjustable trim strip system with the L-bracket and trim stripping attached with angle brackets to a wall.
Figure 28:
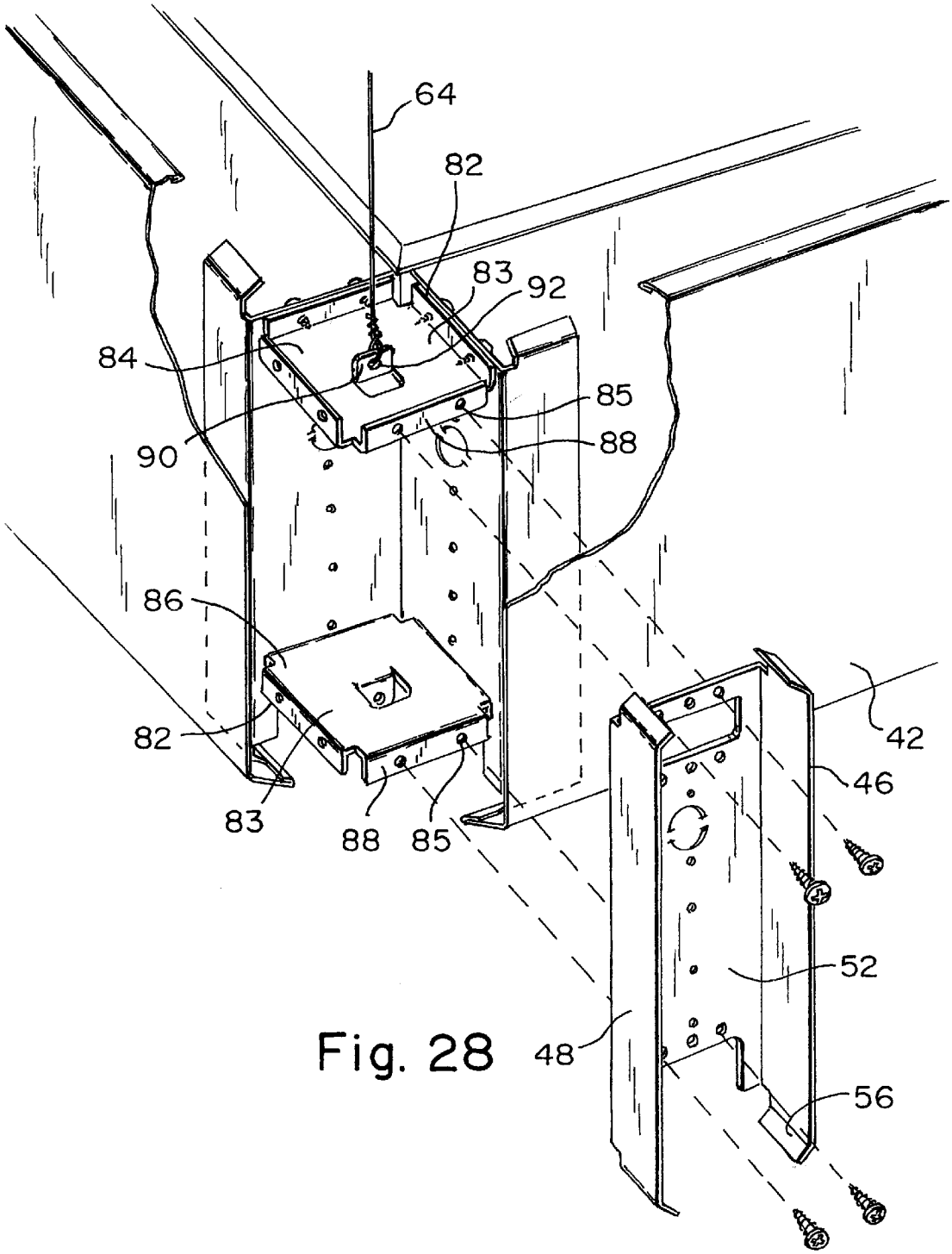
FIG. 28 is a perspective view, as seen from above, of two hubs at a four-way intersection with only three hanger brackets and two pair of trim stripping shown. The upper hub is suspended by a hanger wire.

FIGS. 26 and 27 allow for the adjustable attachment of an L-bracket 116 to a wall or ceiling cap by using angle brackets 118. A pair of angle brackets 118 are slidably attached to the bridge 52 of the L-bracket 116 by use of fasteners through the vertical slots 128 in the long legs 122 of the brackets 118. Once the angle brackets 118 are attached to the trim strip brackets 46, the short legs 120 can be fastened to either the wall or ceiling cap by use of a pair of fasteners such as sheet metal or drywall screws. Vertical adjustment may be necessary to allow for the passage of electrical hardware or signs.

Figure 29:
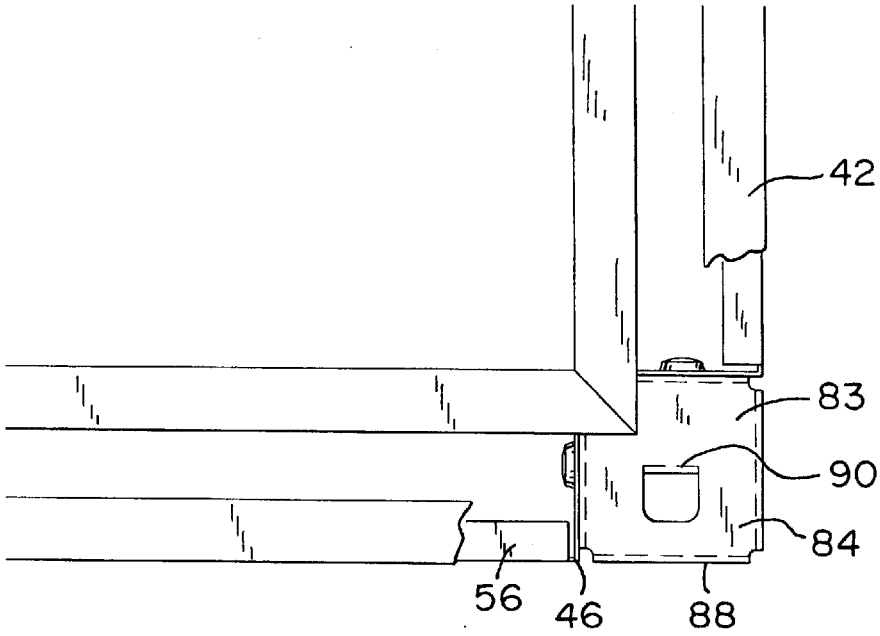
FIG. 29 is a top plan view of the adjustable trim strip system and a hub at a two-way intersection.
Figure 30:
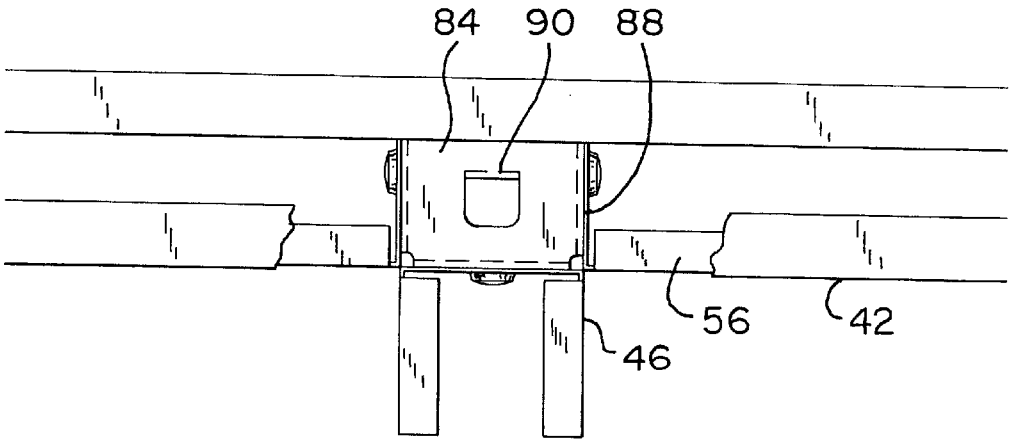
FIG. 30 is a top plan view of the adjustable trim strip system and a hub at a three-way intersection.
Figure 31:
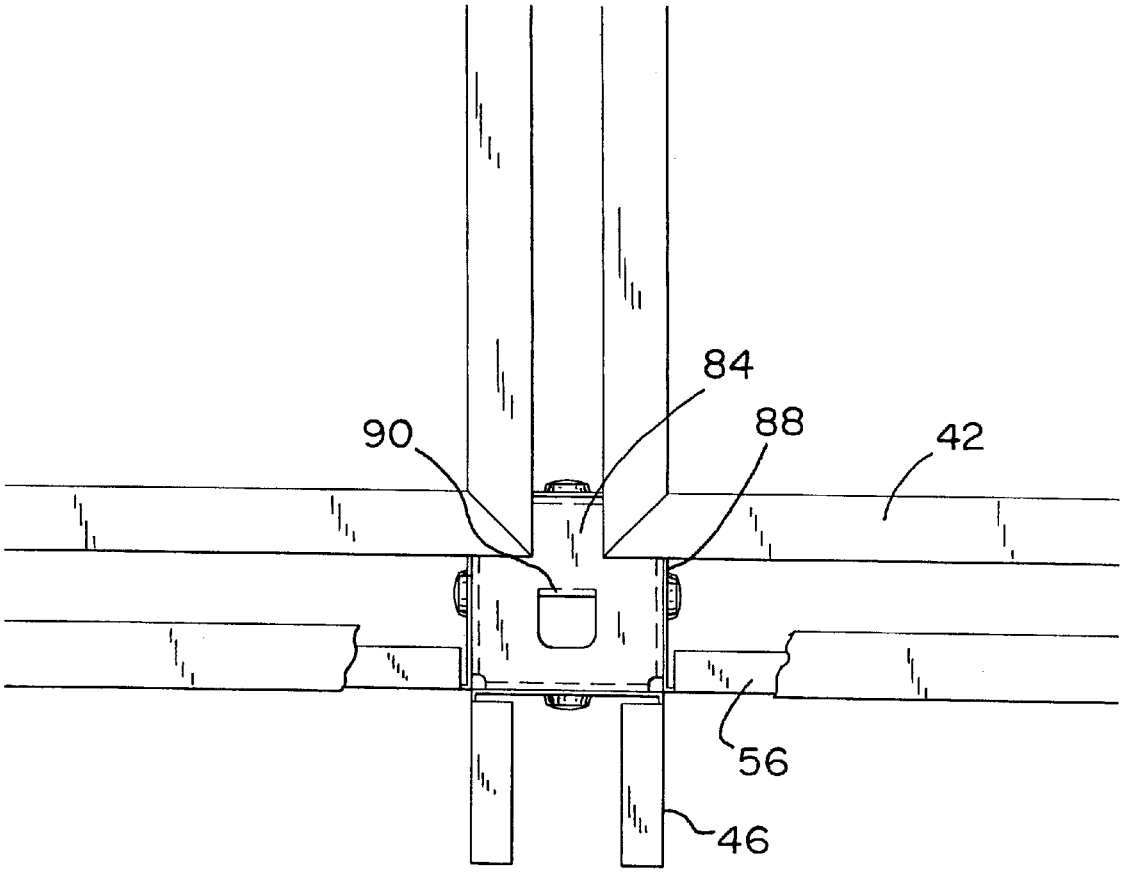
FIG. 31 is a top plan view of the adjustable trim strip system and a hub at a four-way intersection.

FIGS. 28–31 illustrate the various intersections that can be created by attaching one or more brackets 46 to the side edges 88 of a pair of hubs 82. FIG. 28 is a perspective showing how a U-bracket 46 can be attached to a pair of hubs 82. The bracket 46 is attached by the top and bottom portions of the bridge 52 using four fasteners. Once the bracket 46 is in place, the COMPASSO™ trim 42 can be snapped into place on the flanges 56 of the trim clips 48. FIGS. 29–31 are top views of the trim strip system 40 that illustrate two, three and four way intersections. Depending on the intersection formed, it may be necessary to miter the trim stripping 42 at 45 degree angles to allow a proper fit.

Figure 32:
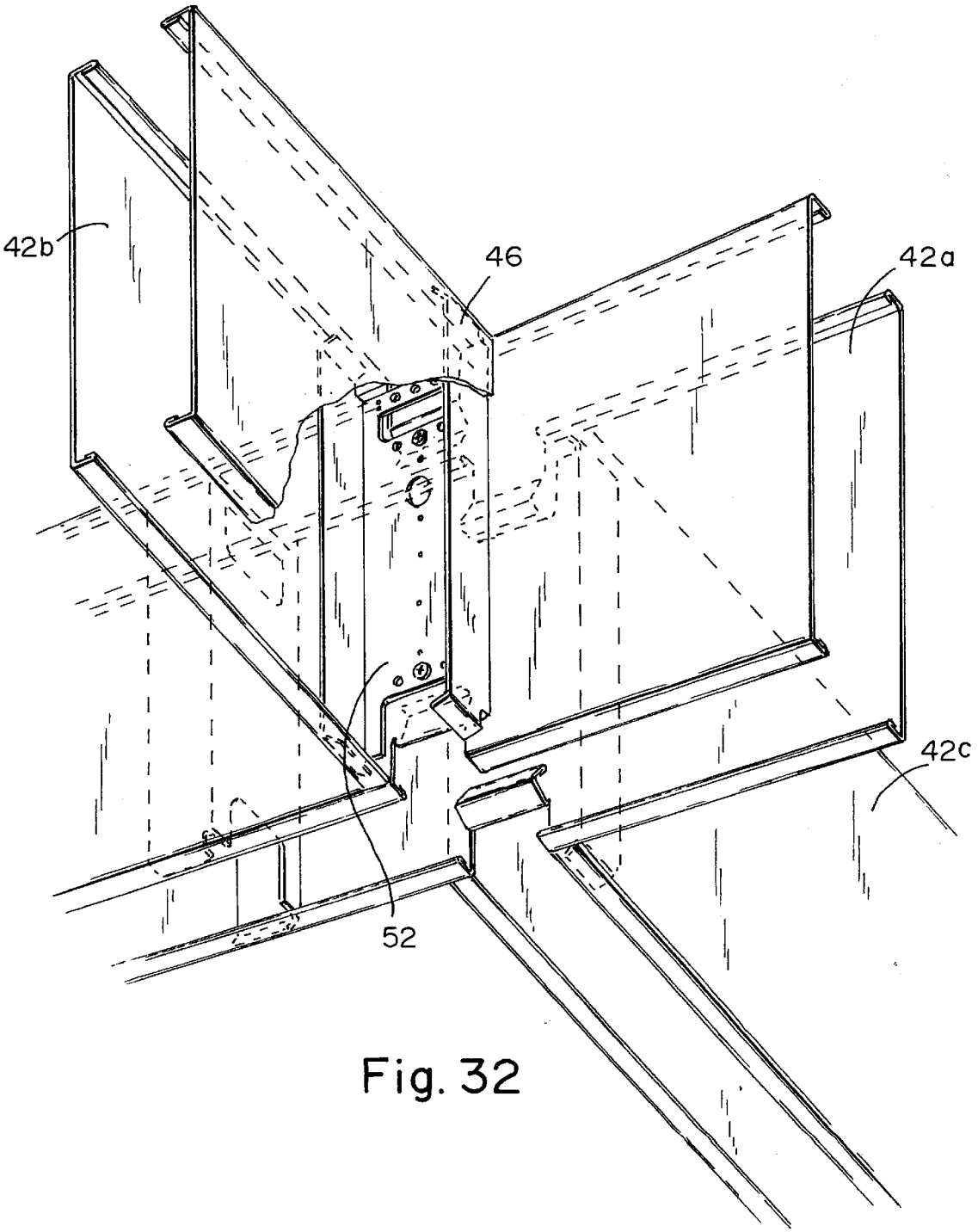
FIG. 32 is a perspective view, as seen from below, of an alternate embodiment of a four-way intersection without hubs. Brackets are attached to the face of a continuous trim stripping which passes through the intersection. Flanges of the pass through trim stripping are cut and folded to maintain e look of a continuous open channel.

An intersection may be formed without the use of hubs 82 as shown in FIG. 32. To create a hubless intersection, a continuous pass through COMPASSO™ trim 42*a* and a pair of COMPASSO™ interrupted trim segments 42*b* and 42*c* are used. The brackets 46 are attached to the face of the pass through COMPASSO™ trim 42*a* by fastening the bridges 52 with screws. To maintain the look of a continuous open channel, the COMPASSO™ trim 42*a* is cut and folded up and inward. The hubless intersection would only require the use of two brackets 46 to form a four-way intersection and would be supported by the bridges 52 of the brackets 46.

Figure 33:
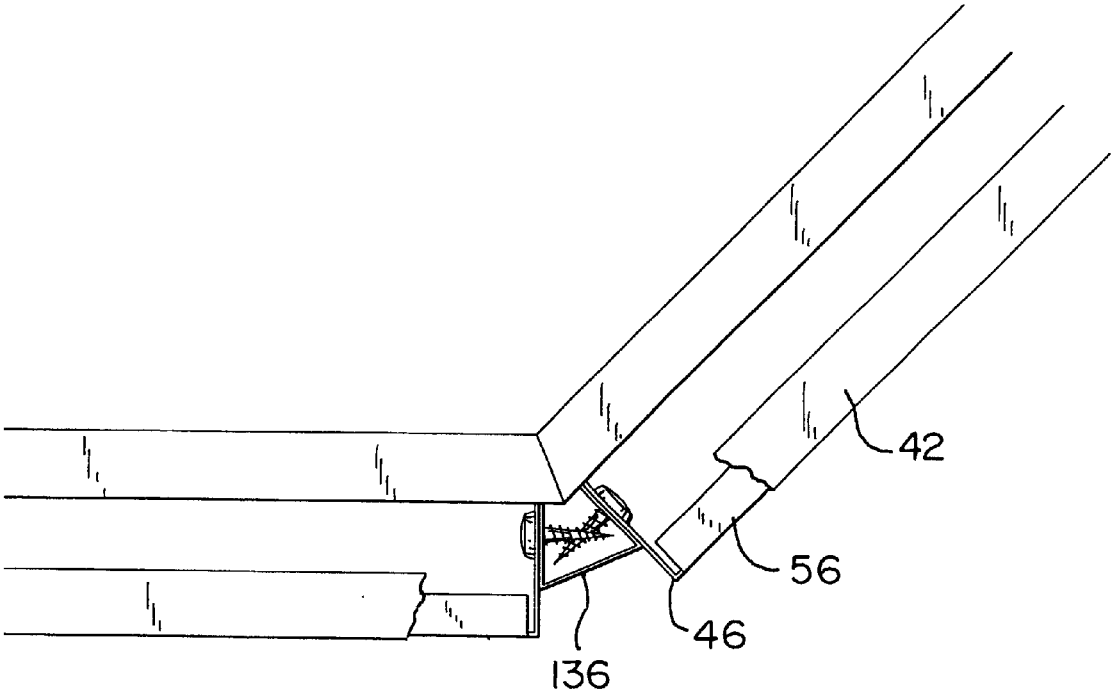
FIG. 33 is a top plan view of the adjustable trim strip system shown at a two way non-right angled intersection with the bridges of the brackets joined by a triangular spacer.
Figure 34:
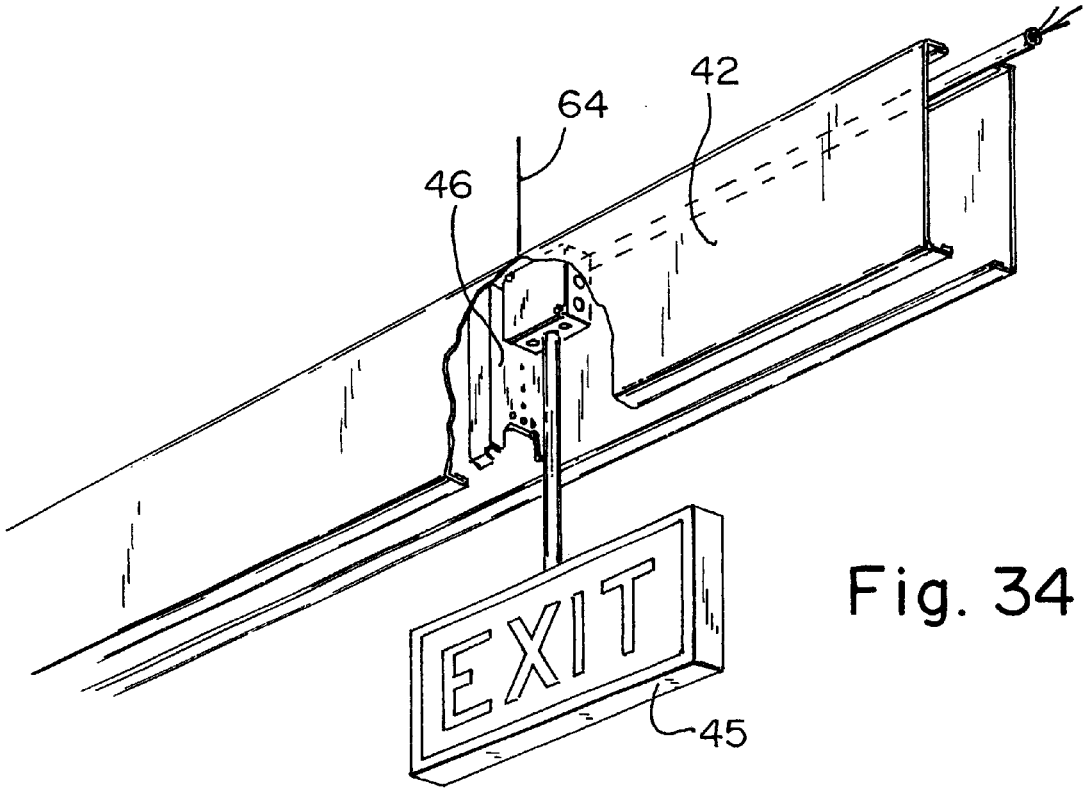
FIG. 34 is a perspective view of the adjustable trim strip system where one of the trim strips is cut away to show the typical attachment of an electrical box and conduit to the bracket for mounting a sign.

Depending on the installation, it may be necessary to form an angled intersection greater or less than 90 degrees. By using a triangle spacer 136, two-way intersections with angles of intersection less than 90 degrees can be formed as shown in FIG. 33. To create an intersection, the bridges 52 of two brackets 46 are connect to two sides a triangular spacer 136 with fasteners. To alter the intersection angle, spacers 136 of varying angles will be produced to allow the intersection to conform to design requirements.

Various features of the invention have been particularly shown and described in connection with the illustrated embodiment of the invention, however, it must be understood that these particular arrangements merely illustrate, and that the invention is to be given its fullest interpretation within the terms of the appended claims.

What is claimed is:

1. An adjustable trim strip system for suspending channel-shaped trim strips from a structure, said trim strip system including:

a bracket adapted to be attached to a structure, form intersections and to allow for the attachment of a trim strip being curvilinear or linear and having a decorative surface; said bracket having trim clips with flanges at each end, said flanges adapted to engage trim flanges on a channel-shaped trim strip at rebates formed at leading edges of said trim flanges;

said bracket further includes a substantially vertical bridge attached to said trim clips, said bridge adapted to allow the attachment of fasteners or hangers to facilitate in the attachment to the structure;

said bridge oriented with respect to said trim clips to provide a space therebetween.

2. The adjustable trim strip system of claim 1, wherein said bracket is of a unitized construction formed from a single section of sheet metal and folded to create said bridge portion and said trim clip portions.

3. The adjustable trim strip system of claim 1, wherein said bracket is of a unitized construction formed from a plastic material to create said bridge portion and said trim clip portions.

4. The adjustable trim strip system of claim 1, wherein said bridge includes a plurality of horizontal apertures for the attachment of a hanger wire or a wire yoke.

5. The adjustable trim strip system of claim 4, wherein said bridge further includes a plurality of vertically extending holes to allow for the attachment of a support device.

6. The adjustable trim strip system of claim 5, wherein said bridge includes a knock-out to allow for the passage of electrical hardware.

7. The adjustable trim strip system of claim 6, wherein said bridge includes one or more notches to allow for the passage of electrical hardware.

8. The adjustable trim strip system of claim 5, wherein said attachable support device includes an angle bracket which comprises a long leg and a short leg;

whereby said long leg is perpendicularly attached to said short leg and includes a vertically extending slot and a plurality of apertures to allow for the adjustable attachment to said bridge; and said short leg includes at least one aperture to allow attachment to a second angle bracket, to a hanger rod, to an electric lighting system, to a wall or to a ceiling.

9. The adjustable trim strip system of claim 5 wherein said bridge further includes a breakable link, said breakable link includes a plurality of apertures to allow the attachment of a hanger device, said breakable link can be severed and folded outwardly to allow for the passage of electrical hardware.

10. The adjustable trim strip system of claim 5 wherein said attachable support device includes a hub which comprises;

a body with side edges;

said body includes a tab with an aperture to allow for the attachment of a hanger device;

said side edges include a plurality of apertures to allow for the attachment of one or more of said brackets to create an intersection.

11. An adjustable trim strip system for the attachment of a trim strip to a structure, said trim strip system including:

a trim strip, a trim clip with flanges at each end, said flanges adapted to engage trim flanges on a section of said trim strip at rebates formed at leading edges of said trim flanges;

a wall mount interconnected to said trim clip by a bridge, said wall mount including a plurality of apertures to allow the passage of fasteners whereby said wall mount can be secured to a structure; and said bridge interconnecting said trim clip and said wall mount and adapted to allow the attachment of fasteners or hangers.

12. An adjustable trim strip system for suspending trim strips from a structure, said trim strip system including:

a trim strip, a bracket comprised of a trim clip with flanges at each end, said flanges adapted to engage trim flanges on said trim strip at rebates formed at leading edges of said trim flanges;

said bracket further including a bridge connected to said trim clip, said bridge adapted to allow for the attachment of a support device to facilitate attachment to said structure.

13. The adjustable trim strip system in claim 12 further including a second adjustable trim strip system that includes a trim clip and a bridge;

said bridge in said adjustable trim strip system in claim 12 is fastened to said bridge of said second adjustable trim strip system so that said trim clip in claim 12 opposes said trim clip of said second adjustable trim strip system to create a combined adjustable trim strip system.

14. A joiner hub joining at least two adjustable trim strip brackets to create an intersection, said hub including;

a body having a first portion for the attachment of a hanger device;

and a second portion for the attachment of one of said at least two brackets;

said at least two brackets having trim clips with flanges at each end, said flanges adapted to engage trim flanges of channel-shaped trim strips at rebates formed at leading edges of said trim flanges; and said at least two brackets further including a substantially vertical bridge spaced between one or more of said trim clips and adapted to be attachable to said second portion of said hub.

15. An intersection system to allow for the joining of two or more adjustable trim strip systems, said intersection system including;

a pass-through section of paired trim strips being attached to a first bracket containing two trim clips interconnected by a bridge;

said trim clips having flanges at each end, said flanges adapted to engage trim flanges on said paired trim strips at rebates formed at leading edges of said trim flanges;

a second bracket being attached to an exterior surface of said pass-through section of paired trim strips at a bridge of said second bracket; and said second bracket includes a pair of trim clips for the attachment of additional sections of other trim strips to form an intersection.

* * * * *